US006085832A

United States Patent [19]

Rehberg

[11] Patent Number: 6,085,832

[45] Date of Patent: Jul. 11, 2000

[54] PLATE HEAT EXCHANGER

[76] Inventor: Michael Rehberg, 13053 Berlin, Rackwitzer Strasse 32, Germany

[21] Appl. No.: 08/930,388

[22] PCT Filed: Mar. 15, 1996

[86] PCT No.: PCT/DE96/00487

§ 371 Date: Dec. 29, 1997

§ 102(e) Date: Dec. 29, 1997

[87] PCT Pub. No.: WO96/29558

PCT Pub. Date: Sep. 26, 1996

[30] Foreign Application Priority Data

Mar. 17, 1995 [DE] Germany ..... 195 10 847

[51] Int. Cl.[7] ..... F28D 9/00

[52] U.S. Cl. ..... 165/167; 165/916

[58] Field of Search ..... 165/166, 167, 165/41, 916, 119

[56] References Cited

U.S. PATENT DOCUMENTS

| | | | |
|---|---|---|---|
| 1,325,637 | 12/1919 | Harrison | 165/167 |
| 2,217,316 | 10/1940 | Kallstenius | 165/167 |
| 2,251,066 | 7/1941 | Persson et al. | 165/167 |
| 4,535,840 | 8/1985 | Rosman et al. | 165/167 |
| 5,179,999 | 1/1993 | Meekins et al. | 165/41 |
| 5,203,832 | 4/1993 | Beatenbough et al. | 165/41 |
| 5,343,936 | 9/1994 | Beatenbough et al. | 165/41 |
| 5,472,045 | 12/1995 | Poehlman | 165/119 |

FOREIGN PATENT DOCUMENTS

| | | |
|---|---|---|
| 0097726 | 1/1984 | European Pat. Off. . |
| 626167 | 8/1927 | France . |
| 2323119 | 4/1977 | France . |
| PS-669442 | 12/1938 | Germany . |
| SP-847454 | 8/1952 | Germany . |
| PS-862757 | 1/1953 | Germany . |
| 1913226 | 8/1970 | Germany . |
| PS-2/615977 | 10/1976 | Germany . |
| 3/210168 | 11/1982 | Germany . |
| OS-3/440064 | 5/1986 | Germany . |
| 8/610463 | 9/1987 | Germany . |
| 3/913100 | 10/1990 | Germany . |
| OS-3/938254 | 5/1991 | Germany . |
| OS-3/827828 | 12/1991 | Germany . |
| OS-4/020735 | 1/1992 | Germany . |
| OS-4/039776 | 6/1992 | Germany . |
| OS-4/128153 | 2/1993 | Germany . |
| WO-9/312397 | 6/1993 | WIPO . |

OTHER PUBLICATIONS

Steinmetz, W.: Der Evolventenwärmeübertrager—ein neues Konstruktionsprinzip des Öl–Wasser–Wärmeübertragers. In: Kraftfahrzeutechnik Feb. 1972, S. 50–52.

*Primary Examiner*—Allen Flanigan
*Attorney, Agent, or Firm*—Horst M. Kasper

[57] ABSTRACT

The invention embodies a plate heat exchanger consisting of a stack of ring-shaped plates of identical size and profile, which face each other with their front and rear sides alternately. The heat exchanger surfaces enclosed between an inside and an outside flat edge have a predominantly wave-shaped profile. The waves trace a spiral path and each of them begins and ends in a plateau impressed up to the height of the wave peaks. The plate has a hole in the middle of each plateau. The plates are welded or soldered in the places where they touch in the stack.

A heat-releasing medium is introduced to the plate heat exchanger from the periphery and flows through it radially. In the radial counterflow, a heat-absorbing medium flows through the heat exchanger and is introduced and flows away via ring tubes on the front sides.

The heat-absorbing, expanding medium has a flow cross section which increases with the radius, and the heat-releasing medium which falls in volume has a decreasing flow cross section. As distinct from known oil coolers, the filer is not connected axially but accommodated in the housing periphery. The result is that the filter has a larger surface and thus also a longerservice life. This also reduces the dynamic load on the heat exchanger (FIG. 2).

23 Claims, 10 Drawing Sheets

PLATE HEAT EXCHANGER

This invention embodies a plate heat exchanger consisting of a stack of ring-shaped plates of identical size and profile, in which identical plates face each other with their front and rear sides alternately and are welded or soldered at the places where they touch or rest against each other. The fields of application of this heat exchanger are above all refrigeration and freezing with evaporating and condensing media, machine cooling and heat transmission processes in which a medium enters the heat exchanger freely from a container.

In known heat exchangers heat-releasing and heat-absorbing media flow through conduits with an almost constant cross section. This cross section may fluctuate around a mean value, e.g. due to the installation of barriers which increase flow turbulence and are thus intended to improve heat transfer, but it neither falls nor grows continuously during the heat exchange. This holds true for the known shell-and-tube exchangers and for known spiral and plate heat exchangers.

The guiding principle for heat exchangers is to accommodate the largest possible heat exchange surfaces in the smallest possible space and to attain high heat transmission values while minimizing pressure losses.

In the DE-PS 669442 and 862757 this principle is implemented by plates arranged in successive layers between which a conduit describing a spiral is arranged for each medium involved in the heat exchange. The media are forced to flow down the whole length of the conduits. This does not permit steady heat transfer with a high degree of efficiency in heat transmission, since the laminar flow which forms produces a boundary layer on the walls, which hinders heat transfer.

To improve heat transfer, overflow openings have been included in the spiral-wound partition walls (DE-PS 2615977) or axially in every other plate of the heat exchanger (DE-PS 3210168). The manufacturing input and consumption of materials, however, is very high for such heat exchangers, while the steps taken do not substantially increase the degree of efficiency.

The heat exchanger according to DE-OS 3327828 was to reduce the weight to such an extent as to permit consideration of its use in space. One medium is channelled down a spiral tube, while the other medium flows radially around this tube from the periphery to the centre where the pressure is lower than at the periphery. In this heat exchanger too, the laminar flow predominates in the tubes and heat exchange is relatively low. When it was realized that turbulence is conducive to heat transfer, the flow was made more turbulent by fitting barriers.

In plate heat exchangers, this was achieved mainly through the profile of the plates, as described, for example, in DE-OS 4020757. The profile usually consists of a wave-shaped imprint with wave peaks and wave valleys of identical cross section transverse to the waves' direction of spread. The wave-shaped profiles describe a straight line and form a sharp angle with the longitudinal axes of the plates, so that for plates positioned at 180° to each other the waves cross and keep the plates apart. The medium flowing in the gap formed between the plates undergoes constant changes of direction and the flow cross section varies periodically. This produces larger heat exchanger surfaces and greater turbulence, which both improve heat transfer. The profiles additionally increase the stability of the plates, so that the latter can be made very thin. This is likewise conducive to heat transfer.

These benefits have been exploited in plate heat exchangers for regenerative gas turbines, e.g. according to U.S. Pat. No. 3,424,240. In heat exchangers of this type, a stack of corrugated, ring-shaped heat exchanger plates bounds a central inlet for the hot turbine exhaust gases. These exhaust gases flow radially between pairs of plates, which in turn have cool compressor air flowing round them in the counterflow, to an outlet at the periphery, which is connected to the turbine combustion chamber. The plates are corrugated to improve the heat exchange between the hot gas flow and the compressor air. The turbine exhaust gas energy is thus transferred to the compressed air, increasing the turbine's degree of efficiency. The ring-shaped plates have only a small radial width, so that the growing cross sections between the plates hardly have any effect on the hot exhaust gases flowing radially outwards.

In known oil coolers, the oil filter is connected axially by a screw connection with the heat exchanger, and the latter in the same manner with the motor, as set out and described in DE-OS 3440064, DE-OS 3938254, DE-OS 4039776 and DE-OS 4128153. This has the disadvantage that the shape and size of the filter are dictated by the cooler and the vibrations which occur in the motor are transmitted via the heat exchanger to the filter, which vibrates on a relatively long lever arm with this type of connection. As a result, the heat exchanger is exposed to high dynamic loads.

The task of the invention is to create a compact plate heat exchanger of low weight which provides an increasing flow cross section for a medium which expand under the influence of heat and a decreasing flow cross section for a cooling medium of falling volume and thus stabilizes the flow and encourages heat transfer. Additionally, this plate heat exchanger is to be designed to improve the conditions for connection of a filter.

This solution to this problem according to the invention is a heat exchanger which consists of a stack of ring-shaped plates of the identical size and profile which are positioned at 180° to each other and thus alternately face each other with their front and their rear sides where a heat-releasing medium is introduced from the periphery and flows radially through every other gap between the plates until it flows away through the conduit enclosed in ring-shaped plates, while a heat-absorbing medium which is introduced and flows away via flanged ring tubes flows around the other side of each plate in the radial counterflow.

The plate heat exchanger according to the present invention comprises a plurality of formed plates of sustantially uniform thickness and furnishing a base level and a raised level formed out of the base level. The base level has an annullar shape. The raised level includes a plurality of n spiral sections forming an n-fold rotation symmetrical pattern around a rotation axis of the annular shape. The plurality of formed plates are placed in a stack such that neighboring formed plates are disposed in each case in a reversed position such that only base levels of neighboring formed plates are abutting to each other and such that only raised levels of neighboring plates are abutting to each other.

Preferably, an outer end of a respective one of the plurality of spiral section ends in an outer wider region, wherein each inner end of a respective one of the plurality of spiral sections ends in an inner wider region, wherein the outer ends, the inner ends, the outer wider regions and the inner wider regions each conform to the n-fold rotation pattern. Each inner wider region can be furnished with an inner opening. Each outer wider region can be furnished with an outer opening. The neighboring formed plates are angularly aligned such that inner wider regions of successive formed plates are aligned along a respective straight line disposed parallel to the n-fold axis and such that outer wider regions of successive plates are aligned along a respective straight line disposed parallel to the n-fold symmetry axis.

According to an embodiment, abutting inner wider regions are sealingly connected to each other and abutting outer wider regions are sealingly connected to each other such that a fluid flowing on the side of the abutting base levels through the spirals forming the raised levels is physically separated from fluid flowing on the side of the abutting raised levels between the spirals forming the raised levels.

The plates have such a profile that adjacent plates either touch and rest against each other with their inside and outside flat edge or with their profiles and enclose a gap between them. The impressed profiles are predominantly wave-shaped and describe a spiral, specifically an Archimedean spiral. The waves can have any cross section. It may be sinus-shaped or trapezoid. Each spiral begins and ends in a plateau impressed up to the height of the wave peaks, and each plateau has a hole in the middle.

The plates are welded or soldered at the places where they touch, that is at the inside and outside flat edges, at the crossing wave peaks and at the plateaus. The holes in the middle of the plateaus thus become axially positioned channels between the gaps for the heat-absorbing medium.

The plates are mainly welded. However, they can be given a coat of solder and welded in the stack, with heat being introduced.

The plate heat exchanger is enclosed in a housing in which a filter, e.g. an oil filter, can be installed to advantage which encloses the entire periphery of the heat exchanger and thus has a filter surface many times greater than known filters for axial connection. This filter is notable for lower pressure losses and a longer service life.

When the filter is connected in this way, the vibrations transmitted by the motor are cushioned and have hardly any negative effect on the stability of the heat exchanger. The highest degree of efficiency in heat transmission with the plate heat exchanger according to the invention is achieved with media which pass from the gaseous to the liquid phase or from the liquid to the gaseous phase during the heat exchange. During these phase changes the volumes of the media alter to an extreme degree. The extreme pressure changes associated with conventional heat exchangers are thus largely avoided with the proposed plate heat exchanger, since the expanding medium has a flow cross section which increases with the radius and the contracting medium has a flow cross section which decreases to the same extent. This raises the degree of efficiency of heat transfer and reduces the demands on the strength of the heat exchanger.

The invention is described by the following practical examples:

FIG. 1 shows a view of a plate and

FIG. 2 a radial section of a plate heat exchanger without housing,

FIG. 3 an axial section AA through a plate heat exchanger with housing,

FIG. 4 is a view similar to that of FIG. 2, however showing a path taken by oil during heat exchange operation, FIG. 5 is a view similar to that of FIG. 3, however showing a path taken by oil during heat exchange operation, FIG. 6 is a view similar to that of FIG. 2, however showing a path taken by water during heat exchange operation, FIG. 7 is a view similar to that of FIG. 3, however showing a path taken by water during heat exchange operation, FIG. 8 is a view from the side of the base level of the annullar plate, FIG. 9 is a schematic sectional view of the annullar plate, FIG. 10 is a view from the side of the raised level of the anullar plate, FIG. 11 is an exploded schematic sectional view of four adjoining anullar plates, FIG. 12 is a view similar to the view of FIG. 1, however exhibiting section indications, FIG. 13 is a schematic sectional view through the anullar plate of FIG. 12 along section line 13—13 and showing several spirals in section, FIG. 14 is a schematic sectional view through the anullar plate of FIG. 12 along section Line 14—14 and showing an outer plateau having a hole in section.

The plate heat exchanger consists of a stack of ring-shaped plates 1 of identical size and profile in which adjacent plates are positioned at 180° to each other and face each other either with their front sides 2 or their rear sides 3.

The inside edge 4 and the outside edge 5 of each plate 1 enclose the heat exchanger surface 6 which has a profile in the shape of a wave 7 of which the wave peaks describe an Archimedean spiral and each begin and end in a plateau 8 impressed up to the height of the wave peaks and in whose middle a hole 9 has been made through the plate 1.

The outer diameter of the plate 1 is many times greater than its inner diameter in order to obtain a large heat exchanger surface 6.

In the case of adjacent plates 1, either their touching flat edges 4 and 5 or their touching plateaus 8 and the crossing waves are laser-welded at the points where they touch.

The axial conduits 10 and 11 formed by the holes 9 are connected to the ring tubes 12 and 13 on the front sides of the plate heat exchanger.

The plate heat exchanger is enclosed in a housing 14 with a filter 15 fitted on the periphery.

Figure 2:
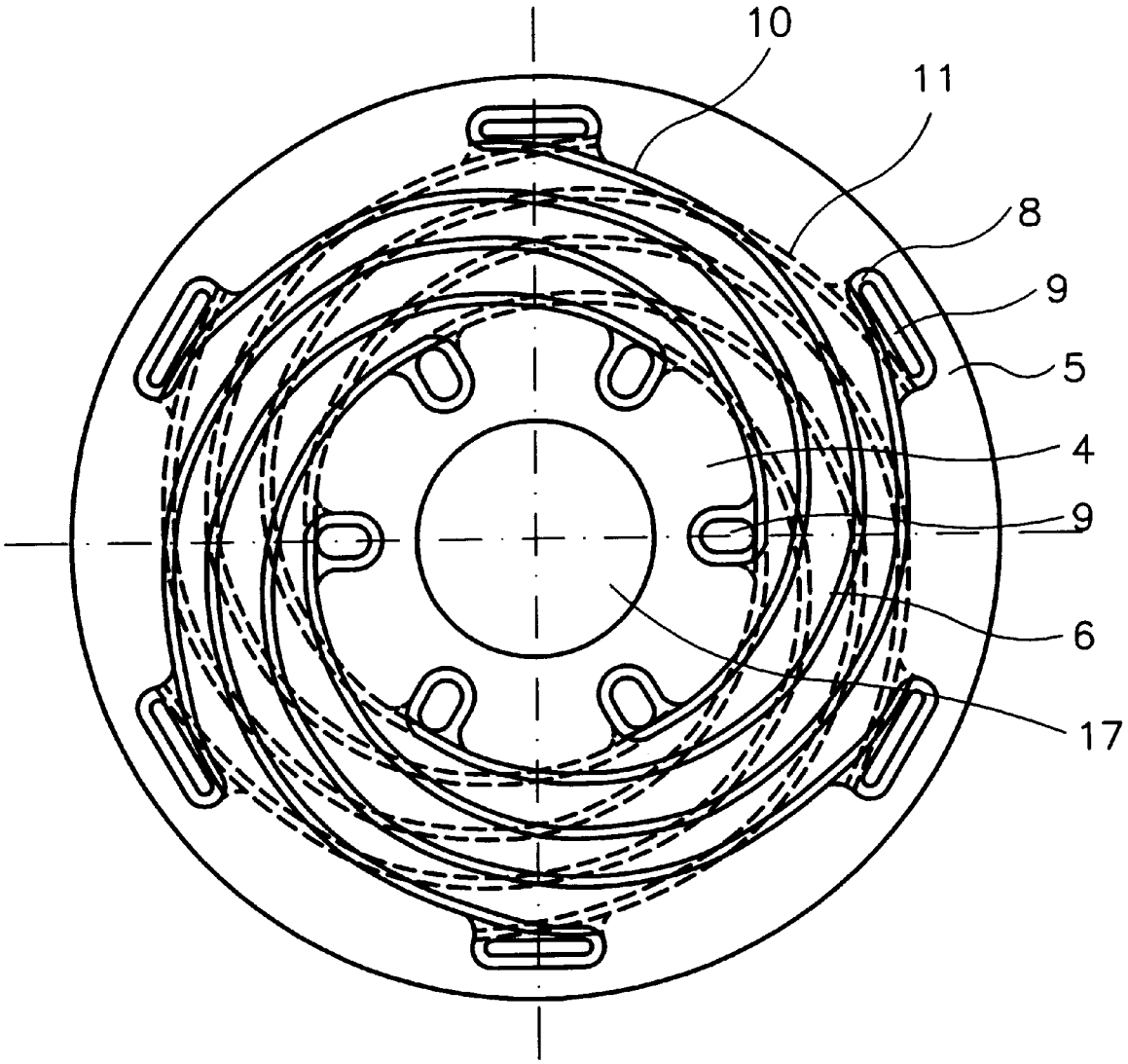
Figure 6:
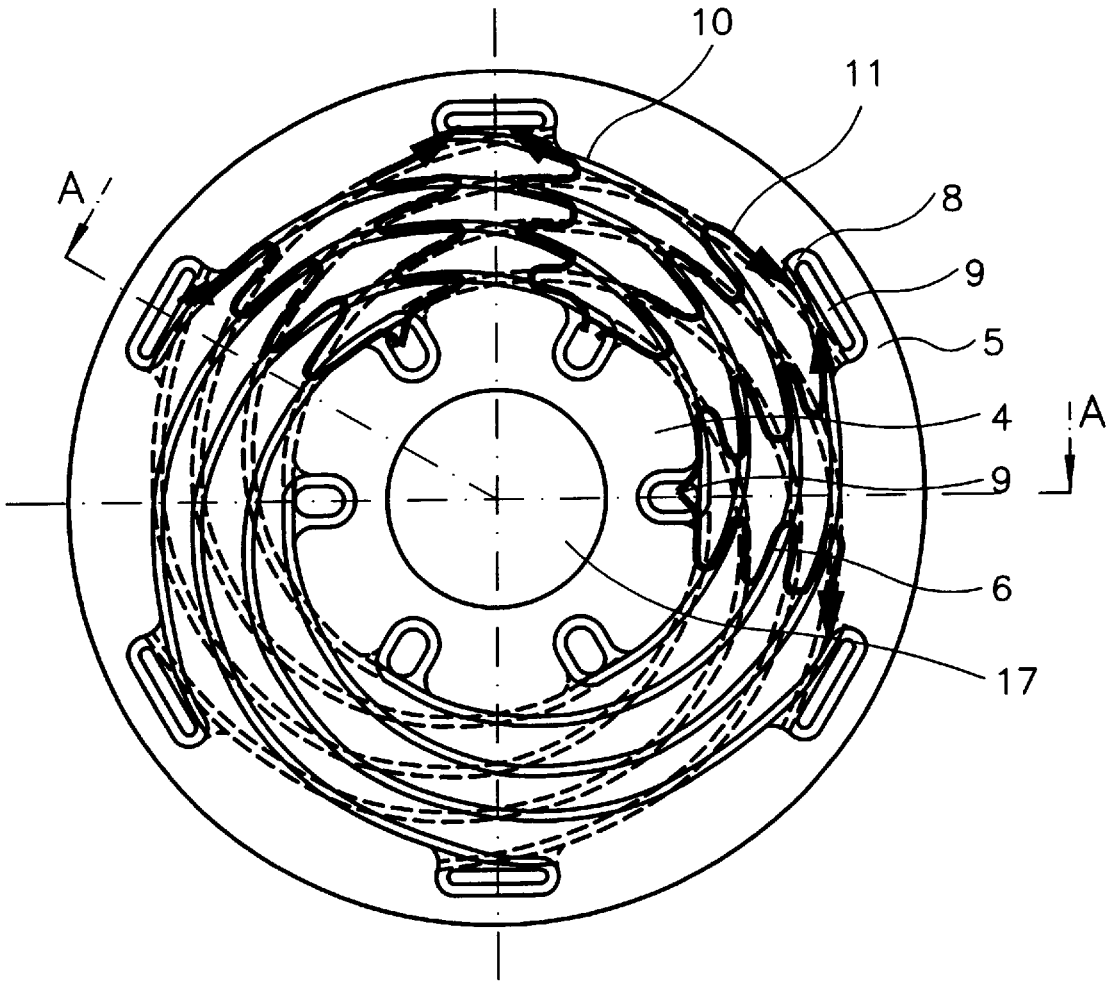

FIG. 6 is a view like that of FIG. 2, however additionally indicating the flow of water from the inner openings to the outer openings. One or more generally radial flow paths can be recognized in FIG. 6. The water flows from the holes in the inner raised plateaus to the holes 9 in the outer raised plateaus 8.

Figure 3:
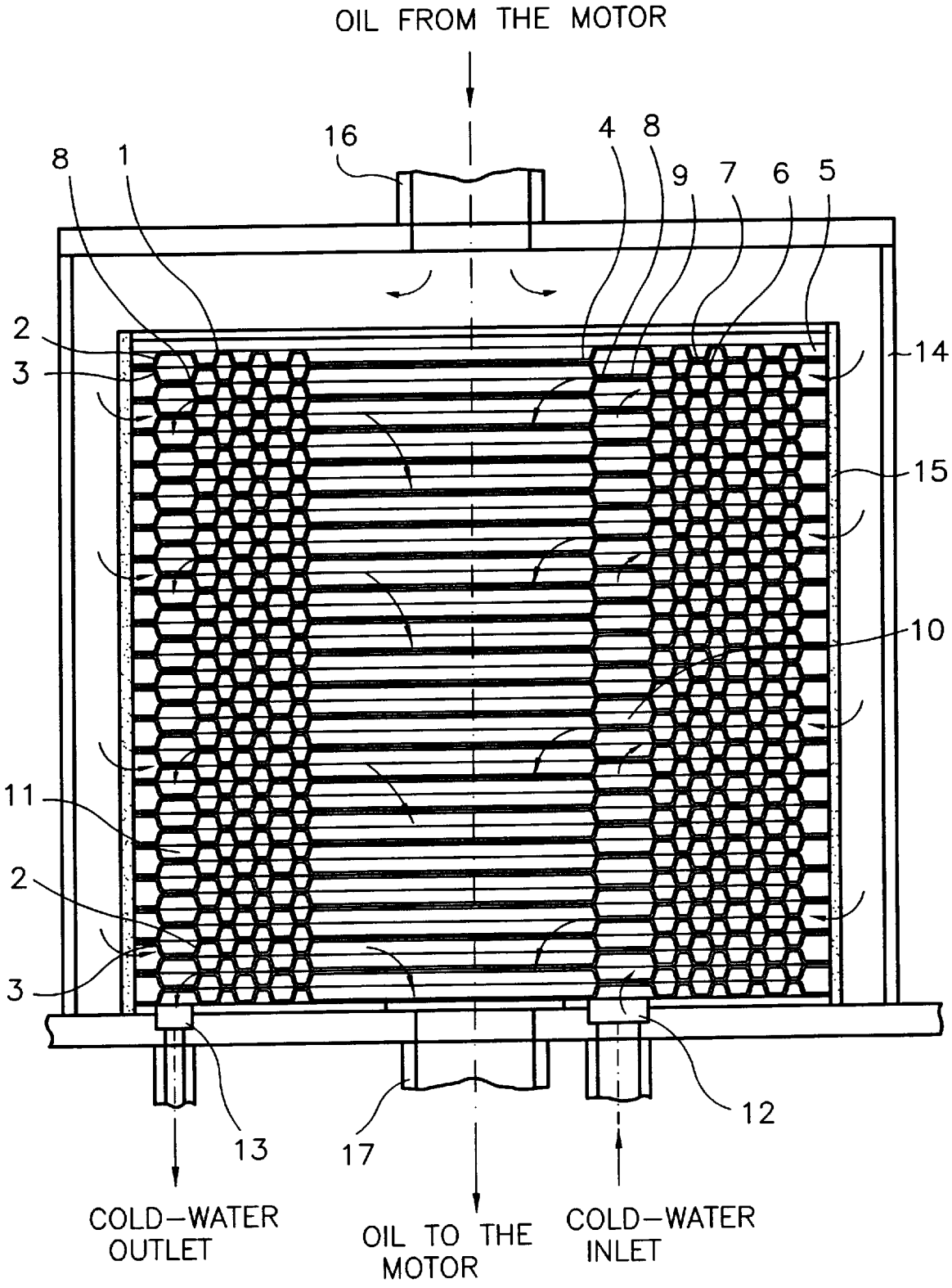
Figure 4:
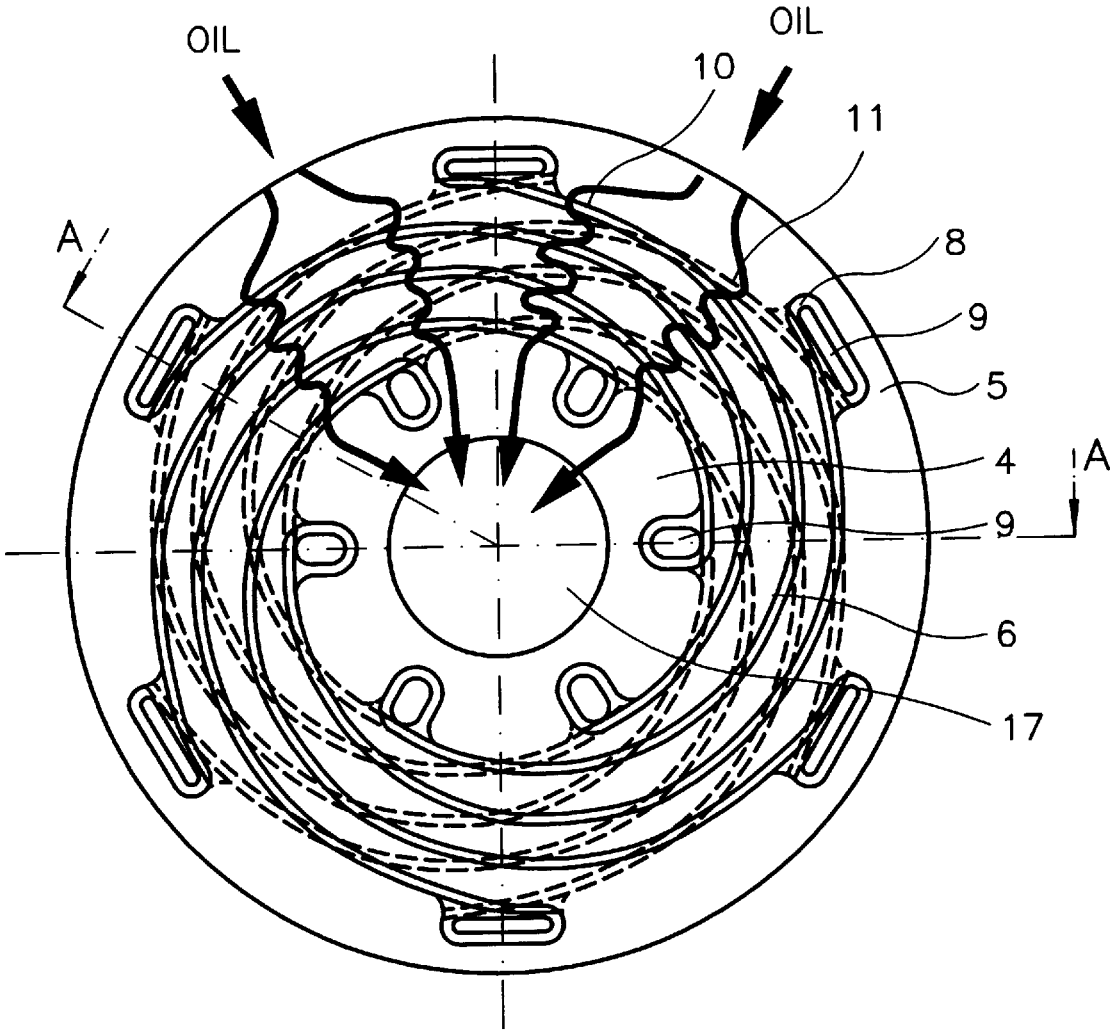
FIG. 4 is a view like that of FIG. 2, however additionally indicating the flow of oil from the outside of the filter surrounding the stack of annular plates to the center of the annullar plates. One or more generally radial flow paths can be recognized in FIG. 4.
Figure 5:
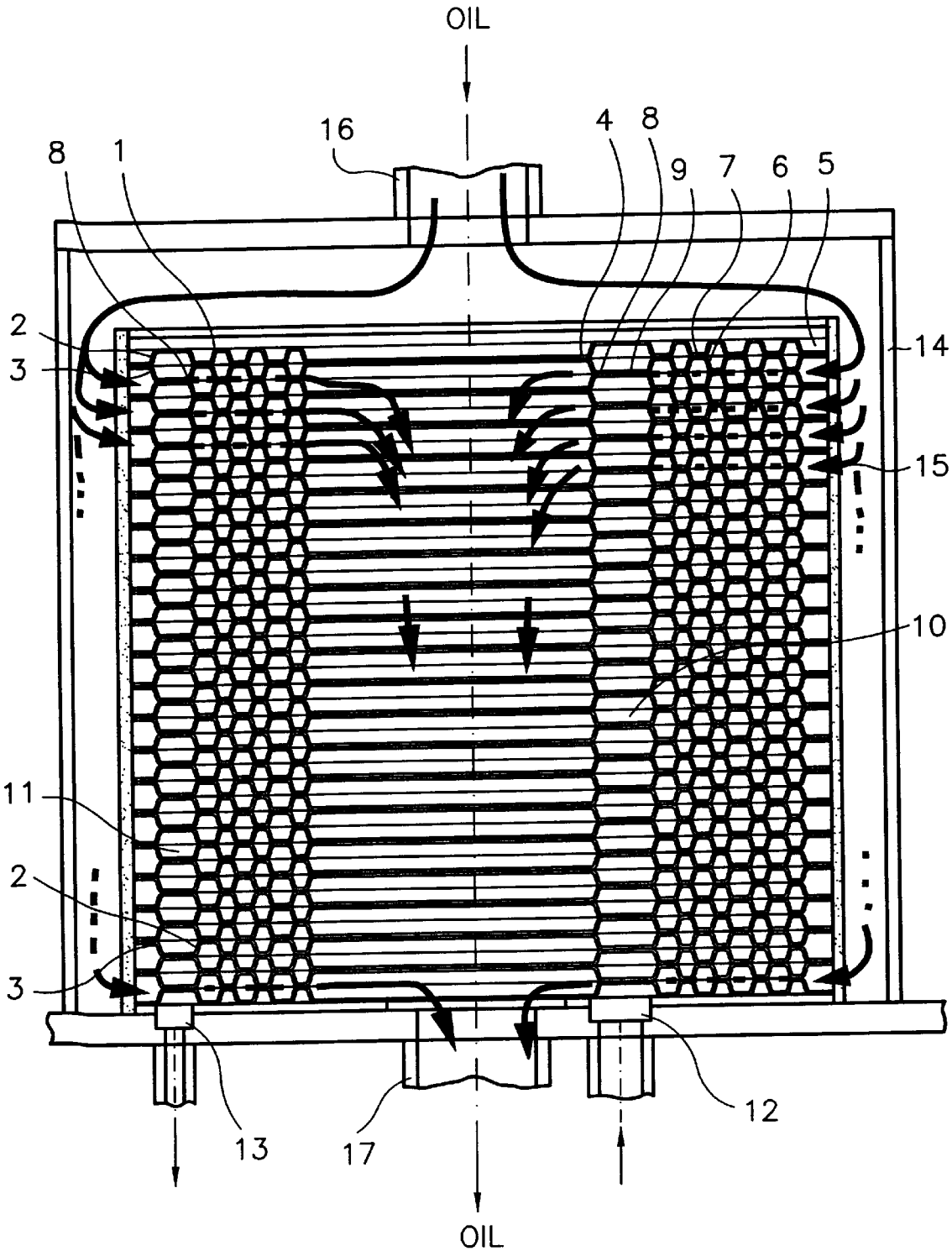
FIG. 5 is a view like that of FIG. 3, however additionally indicating the flow of oil from the outside of the filter surrounding the stack of annular plates to the center of the annullar plates. It can be recognized that the oil flows from the periphery of the heat exchanger in between in each case two raised sides of two neighboring anullar plates to the center openings of the anullar plates.
Figure 7:
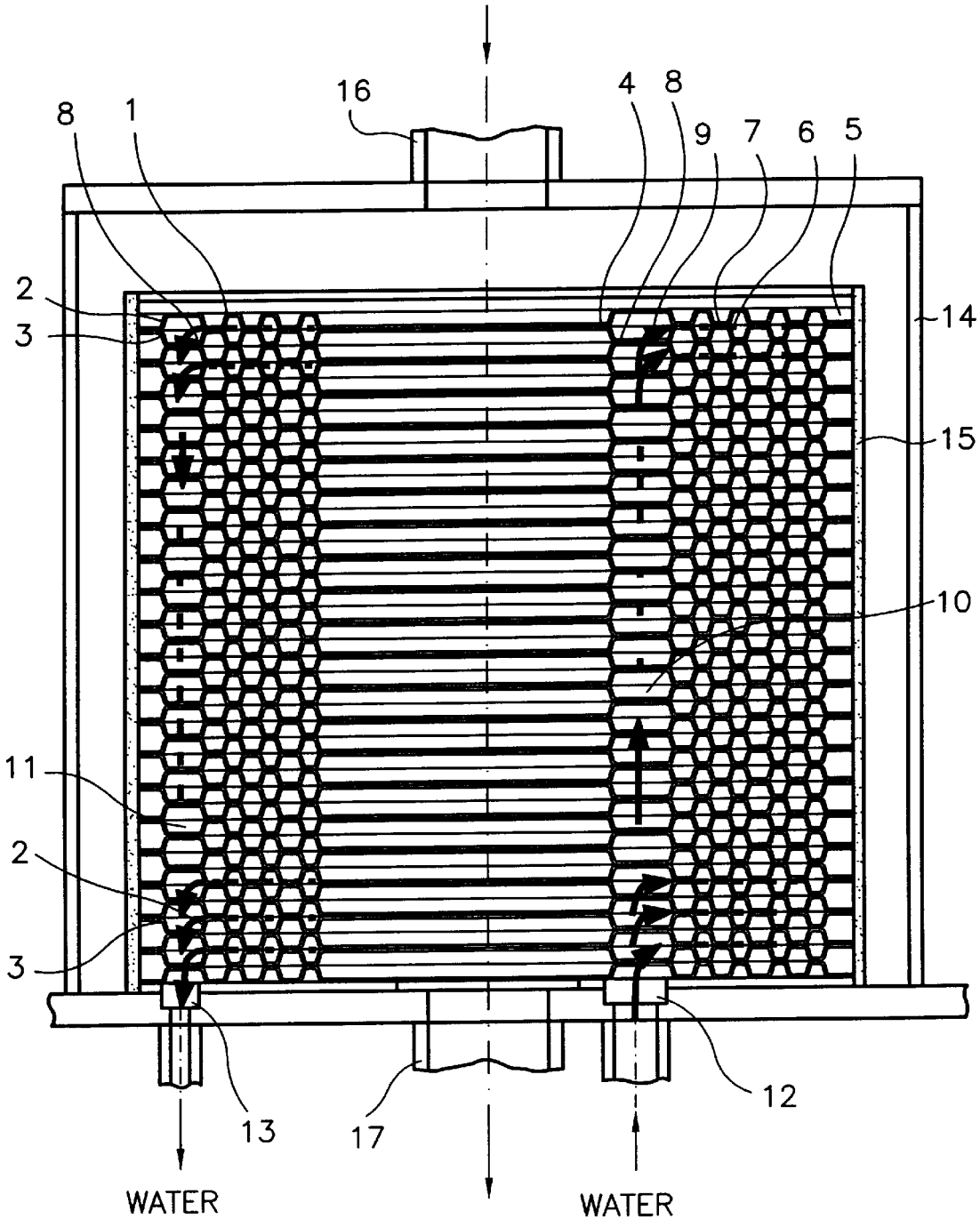

FIG. 7 is a view like that of FIG. 3, however additionally indicating the flow of water from the holes in the inner raised plateaus through the spirals as formed in the respective base side of two neighboring anullar plates with mutually facing base sides to the outer holes in the outer raised plateaus.

Figure 8:
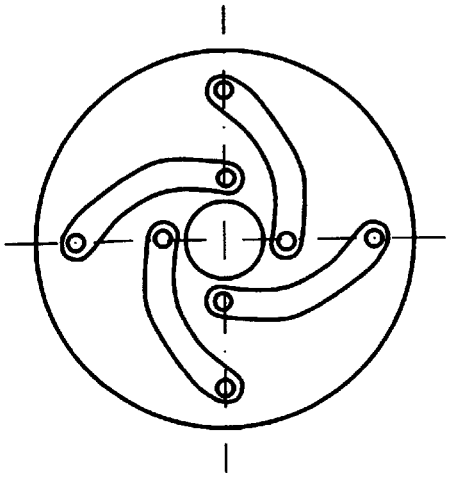
Figure 9:
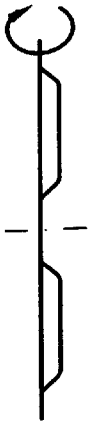
Figure 10:
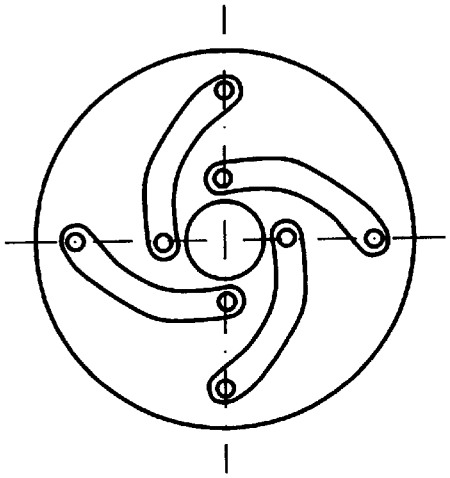

FIG. 9 shows a schematic sectional view through a diameter of the anullar plate. FIG. 8 shows a side elevational view onto the base side of the anullar plate of FIG. 9 and FIG. 10 shows a side elevational view onto the raised side of the anullar plate shown in FIG. 8. Thus the facing spirals facing each other on two neighboring base sides criss-cross and the facing spirals facing each other on two neighboring raised sides also criss-cross.

Figure 11:
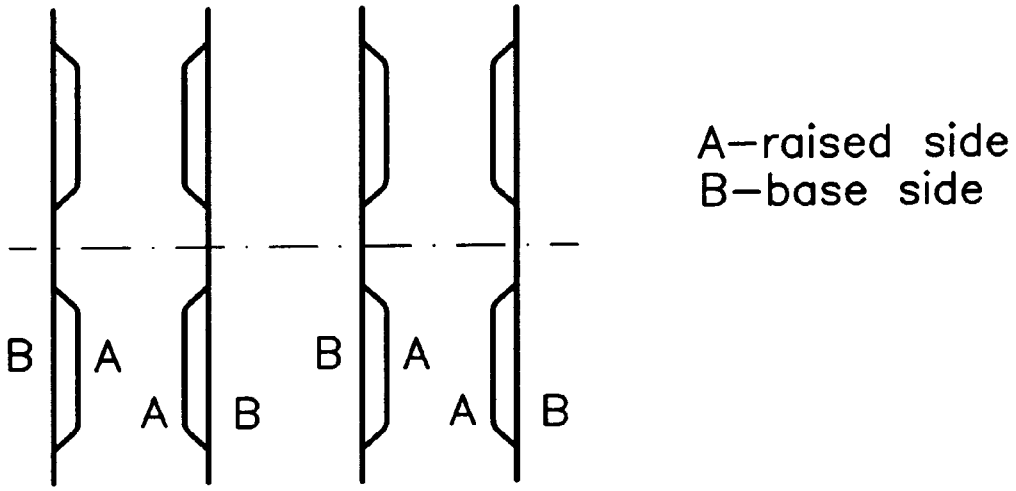

FIG. 11 is a schematic diagram illustrating the relative positioning of four indentically formed anullar plates in a sequence where standard and inverse positions of the anullar plates alternate. It can be recognized that in each case either two raised sides of two neighboring anullar plates face each other or two base sides of two neighboring anullar plates face each other. The raised sides of the anullar plates are designated with the letter "A" in FIG. 11 and the base sides of the anullar plates are designated with the letter "B" in FIG. 11. In other words, FIG. 11 illustrates schematically the relative disposition of the annular plates such that raised sides contact each other and such that base sides contact each other.

Figure 1:
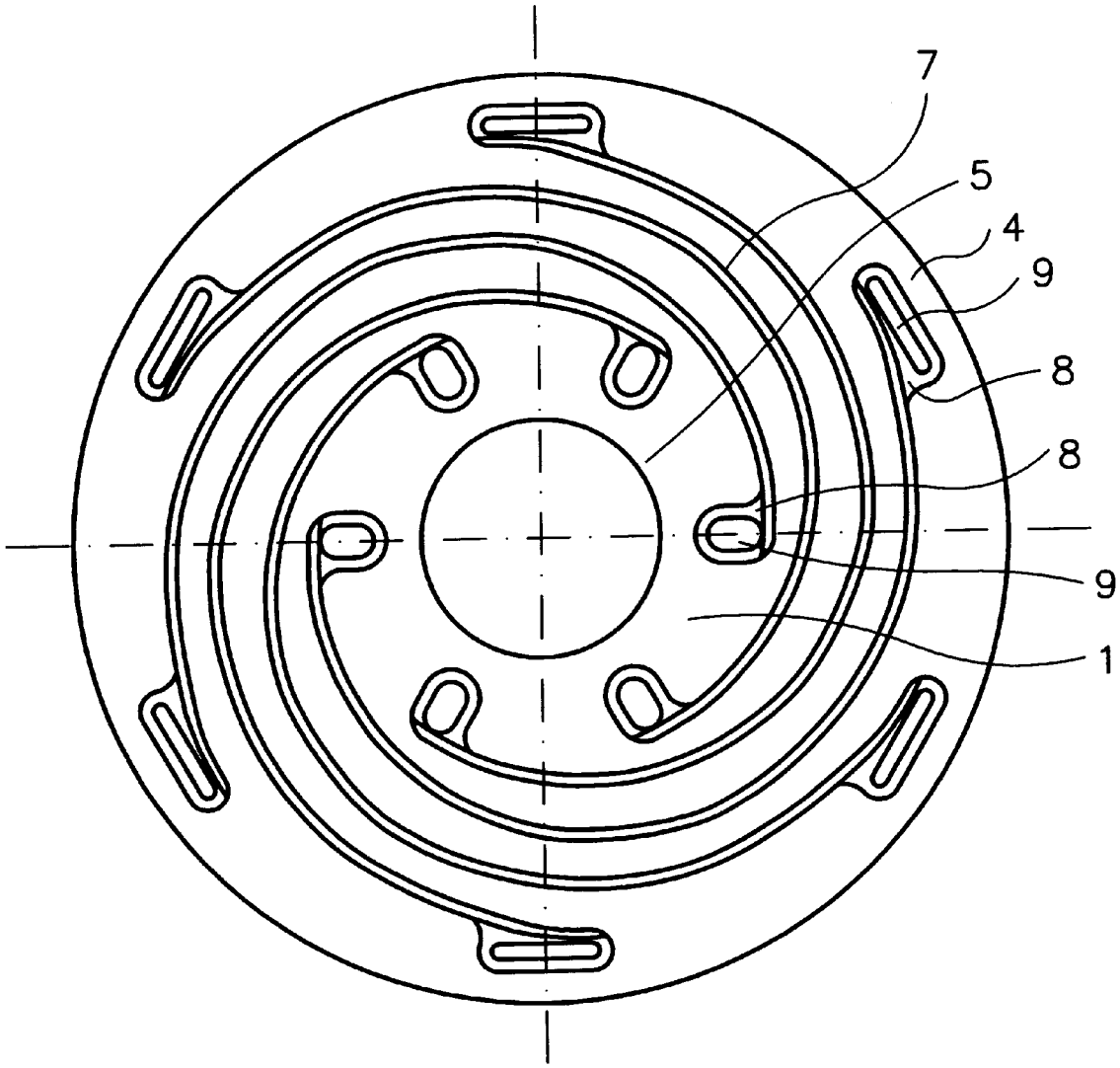
Figures 12, 13, 14:
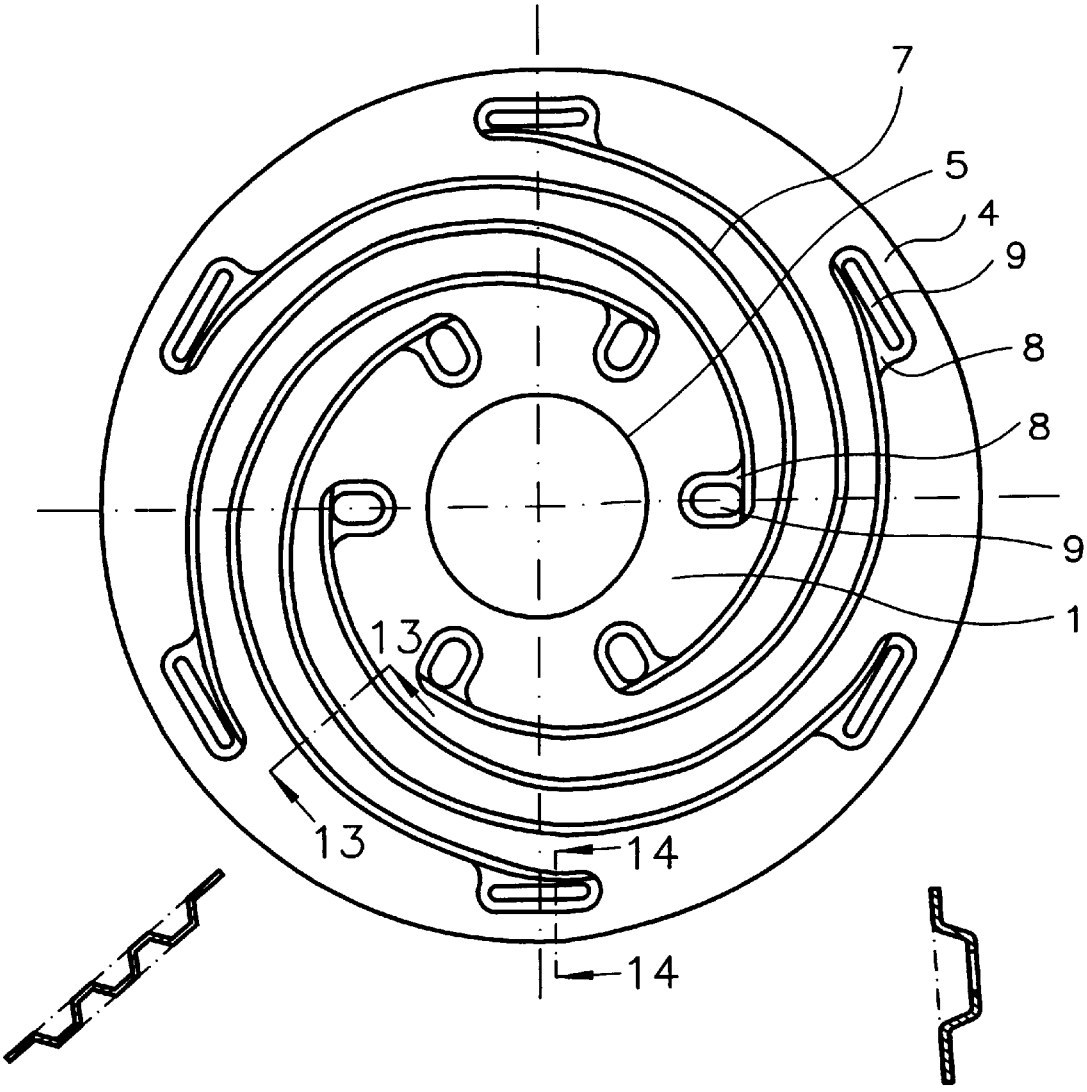

FIG. 12 illustrates schematically a view similar to that of FIG. 1, however cross-sectional views of a plurality of spirals and of a plateau or wider region with opening are additionally shown.

FIG. 13 shows a section through several spirals and it can be recognized how the spirals are raised from the base level of the anullar plate.

FIG. 14 shows a section through an outer plateau having a hole. Since the raised faces of the outer plateaus are sealingly joined together, the water flowing through the spirals between two neighboring base sides of two plates is discharged through a stack of aligned holes in outer plateaus.

FIGS. 1 and 2 show the plates exhibiting a 6-fold symmetry axis. The plates are welded, laser-welded or soldered at places where they touch as shown in FIG. 3. The spirals raised in the anullar plate have a wave shaped cross-section as shown in FIGS. 3 and 13. As shown in FIG. 3, the holes in the inner plateaus are aligned to form an inner axially parallel conduit. As shown in FIG. 3, the holes in the outer plateaus are aligned to form an outer axially parallel conduit. A filter surrounds the outer perifery of the stack of annular plates as seen in FIG. 3. The outer wider region or outer plateau exhibits an about elongated shape with the elongation direction disposed perpendicular to a radius of the respective annular plate as seen in FIGS. 1 and 2. The inner wider region exhibits an about elongated shape with the elongation direction disposed parallel to a radius of the respective annular plate as seen in FIGS. 1 and 2. FIG. 3 shows that a housing surrounds the stack of plates.

The filter 15 is fed with hot oil via the line 16 from the motor, and the oil flows through the filter 15 into the heat exchanger and, after cooling, via the line 17 back to the motor. The oil is cooled by water which is let in and out via the ring tubes 12 and 13.

Legend

1 Plate of plate heat exchanger

2 Front side of the plate 1

3 Rear side of the plate 1

4 Inside flat edge of the plate 1

5 Outside flat edge of the plate 1

6 Heat exchanger surface of the plate 1

7 Impressed corrugation in the heat exchanger surface 6

8 Impressed plateau at the beginning and end of each corrugation 7

9 Hole through the plate 1

10 Axial conduits on the inside edge 4

11 Axial conduits on the outside edge 5

12 Ring tube on conduits 10

13 Ring tube on conduits 11

14 Housing of the plate heat exchanger

15 Filter

16 Line from the motor to the plate heat exchanger

17 Line from the plate heat exchanger to the motor

I claim:

1. Plate heat exchanger consisting of a stack of ring-shaped plates of identical size and profile which alternately face each other with their front and rear sides, having the distinguishing feature that on one side of the plates (1) a heat-releasing medium introduced from the periphery flows radially to the center along one or more generally radial flow paths and flows away via the conduit enclosed by the ring-shaped plates, while on the other side a heat-absorbing medium flows radially along one or more generally radial flow paths in the counterflow and flows in and out on the front sides.

2. Plate heat exchanger according to claim 1, having the distinguishing feature that the plates (1) are ring-shaped, their outer diameter is many times greater than their inner diameter and that the heat exchanger surfaces (6) enclosed by an inside flat edge (4) and an outside flat edge (5) have a wave (7) profile, describing a spiral and beginning and ending in a plateau ((8) impressed up to the height of the wave peaks, with a hole (9) made in the middle of the plates (1) and the inside and outside edges (4) and (5), plateaus (8) and crossing waves (7) of the plates (1) being welded or soldered together.

3. Plate heat exchanger according to claim 1, having the distinguishing feature that the wave-shaped profiles describe Archimedean spirals.

4. Plate heat exchanger according to claim 1, having the distinguishing feature that the waves (7) have a sinusoidal-shaped or trapezoid cross section.

5. Plate heat exchanger according to claim 1, having the distinguishing feature that it is enclosed in a housing (14) incorporating a filter (15).

6. Plate heat exchanger consisting of a stack of ring-shaped plates of identical size and profile which alternately face each other with their front and rear sides, having the distinguishing feature that on one side of the plates (1) a heat-releasing medium introduced from the periphery flows radially to the centre and flows away via the conduit enclosed by the ring-shaped plates, while on the other side a heat-absorbing medium flows radially in the counterflow and flows in and out on the front sides and having the distinguishing feature that plateaus (8) and holes (9) made in their middle have the shape of ovals at the inside edge (4), with a radial longitudinal axis and the shape of kidneys at the outside edge (5), with a longitudinal axis parallel to the periphery.

7. A plate heat exchanger comprising a plurality of formed plates of substantially uniform thickness and furnishing a base level and a raised level formed out of the base level;

wherein the base level has an annullar shape;

wherein the raised level includes a plurality of n spiral sections forming an n-fold rotation symmetrical pattern around a rotation axis of the annular shape;

wherein the plurality of formed plates are placed in a stack such that neighboring formed plates are disposed in each case in a reversed position such that only base levels of neighboring formed plates are abutting to each other and such that only raised levels of neighboring plates are abutting to each other.

8. The plate heat exchanger according to claim 7, wherein an outer end of a respective one of the plurality of spiral section ends in an outer wider region;

wherein each inner end of a respective one of the plurality of spiral sections ends in an inner wider region;

wherein the outer ends, the inner ends, the outer wider regions and the inner wider regions each conform to the n-fold rotation pattern;

wherein each inner wider region is furnished with an inner opening;

wherein each outer wider region is furnished with an outer opening;

wherein the neighboring formed plates are angularly aligned such that inner wider regions of successive formed plates are aligned along a respective straight line disposed parallel to the n-fold axis and such that outer wider regions of successive plates are aligned along a respective straight line disposed parallel to the n-fold symmetry axis.

9. The plate heat exchanger according to claim 8, wherein abutting inner wider regions are sealingly connected to each other and wherein abutting outer wider regions are sealingly connected to each other such that a fluid flowing on the side of the abutting base levels through the spirals forming the raised levels is physically separated from fluid flowing on the side of the abutting raised levels between the spirals forming the raised levels.

10. The plate heat exchanger according to claim 7 wherein a the plates exhibit a 6-fold symmetry axis.

11. The plate heat exchanger according to claim 7, wherein the plates are welded at places where they touch.

12. The plate heat exchanger according to claim 7, wherein the plates are soldered at places where they touch.

13. The plate heat exchanger according to claim 7, wherein the plates are laser-welded at places where they touch.

14. The plate heat exchanger according to claim 7, wherein the spirals have a wave shaped cross-section.

15. The plate heat exchanger according to claim 7, wherein the spirals have a sinusoidal shaped cross-section.

16. The plate heat exchanger according to claim 7, wherein the spirals have a trapezoidal shaped cross-section.

17. The plate heat exchanger according to claim 7, wherein the inner openings form an inner axial conduit.

18. The plate heat exchanger according to claim 7, wherein the outer openings form an outer axial conduit.

19. The plate heat exchanger according to claim 7 further comprising a filter surrounding the outer perifery of the stack of annular plates.

20. The plate heat exchanger according to claim 7, wherein the outer wider region exhibits an approximately elongated shape with the elongation direction disposed perpendicular to a radius of the respective annular plate.

21. The plate heat exchanger according to claim 7, wherein the inner wider region exhibits an approximately elongated shape with the elongation direction disposed parallel to a radius of the respective annular plate.

22. The plate heat exchanger according to claim 7 further comprising a housing surrounding the stack of plates.

23. The plate heat exchanger according to claim 7, wherein the spirals are Archimedian spirals.

* * * * *